US009349517B2

(12) United States Patent
Matsuura et al.

(10) Patent No.: US 9,349,517 B2
(45) Date of Patent: May 24, 2016

(54) COIL COMPONENT

(75) Inventors: Hitoshi Matsuura, Takasaki (JP); Tomomi Kobayashi, Takasaki (JP); Yoshikazu Okino, Takasaki (JP); Hidemi Iwao, Takasaki (JP); Kenichiro Nogi, Takasaki (JP); Kenji Otake, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 0 days.

(21) Appl. No.: 13/313,982

(22) Filed: Dec. 7, 2011

(65) Prior Publication Data

US 2012/0188046 A1 Jul. 26, 2012

(30) Foreign Application Priority Data

Jan. 20, 2011 (JP) ..... 2011-009886
Oct. 24, 2011 (JP) ..... 2011-232371

(51) Int. Cl.

| | |
|---|---|
| ***H01F 27/24*** | (2006.01) |
| ***H01F 5/00*** | (2006.01) |
| ***H01F 27/28*** | (2006.01) |
| ***H01F 17/00*** | (2006.01) |

(52) U.S. Cl.

CPC ..... *H01F 17/0033* (2013.01)

(58) Field of Classification Search

CPC ..... H01F 17/033
USPC ..... 336/200, 223, 232
See application file for complete search history.

(56) References Cited

U.S. PATENT DOCUMENTS

| | | | | |
|---|---|---|---|---|
| 4,129,444 | A | | 12/1978 | Dreyer et al. |
| 5,352,522 | A | | 10/1994 | Kugimiya et al. |
| 5,522,946 | A | | 6/1996 | Tomita et al. |
| 5,997,999 | A | * | 12/1999 | Horiuchi et al. ..... 428/210 |
| 6,051,324 | A | | 4/2000 | Moorhead et al. |
| 6,392,525 | B1 | | 5/2002 | Kato et al. |
| 6,515,568 | B1 | | 2/2003 | Maki et al. |
| 6,764,643 | B2 | | 7/2004 | Sagawa et al. |
| 6,784,782 | B2 | | 8/2004 | Inoue et al. |

(Continued)

FOREIGN PATENT DOCUMENTS

| | | | |
|---|---|---|---|
| CN | 101308719 | A | 11/2008 |
| CN | 101927344 | A | 12/2010 |

(Continued)

OTHER PUBLICATIONS

A Notification of First Chinese Office Action with Search Report issued by the State Intellectual Property Office of China, issued on Nov. 26, 2013, for Chinese counterpart application No. 201210005436.0.

(Continued)

*Primary Examiner* — Mangtin Lian
*Assistant Examiner* — Ronald Hinson
(74) *Attorney, Agent, or Firm* — Law Office of Katsuhiro Arai

(57) ABSTRACT

A coil component is of the type where a helical coil is directly contacting a magnetic body where such coil component still meets the demand for electrical current amplification. The coil component is structured in such a way that a helical coil is covered with a magnetic body. The magnetic body is mainly constituted by magnetic alloy grains and does not contain glass component, and each of the magnetic alloy grains has an oxide film of the grain on its surface.

20 Claims, 4 Drawing Sheets

(56) References Cited

U.S. PATENT DOCUMENTS

| | | | | |
|---|---|---|---|---|
| 6,814,928 | B2 | 11/2004 | Sagawa et al. | |
| 7,422,697 | B2 | 9/2008 | Takahashi et al. | |
| 7,446,638 | B2 | 11/2008 | Nogi | |
| 7,719,399 | B2 | 5/2010 | Iwasaki | |
| 7,843,701 | B2 | 11/2010 | Kudo et al. | |
| 8,018,313 | B2 | 9/2011 | Tada et al. | |
| 8,416,051 | B2 | 4/2013 | Matsuura et al. | |
| 2004/0140016 | A1 | 7/2004 | Sakamoto et al. | |
| 2004/0209120 | A1 | 10/2004 | Inoue et al. | |
| 2007/0159282 | A1* | 7/2007 | Huang et al. | 336/83 |
| 2007/0290161 | A1 | 12/2007 | Tokuoka et al. | |
| 2008/0003126 | A1 | 1/2008 | Watanabe et al. | |
| 2008/0012679 | A1 | 1/2008 | Okabe et al. | |
| 2008/0029300 | A1 | 2/2008 | Harada et al. | |
| 2008/0061264 | A1 | 3/2008 | Maeda et al. | |
| 2008/0152897 | A1 | 6/2008 | Maeda et al. | |
| 2008/0231409 | A1 | 9/2008 | Kugai et al. | |
| 2008/0278273 | A1 | 11/2008 | Lee et al. | |
| 2009/0003191 | A1 | 1/2009 | Inuzuka et al. | |
| 2009/0045905 | A1* | 2/2009 | Nakagawa et al. | 336/232 |
| 2009/0102589 | A1 | 4/2009 | Lee et al. | |
| 2009/0140833 | A1* | 6/2009 | Tan et al. | 338/21 |
| 2010/0033286 | A1* | 2/2010 | Katayama et al. | 336/200 |
| 2010/0253463 | A1 | 10/2010 | Shimomura et al. | |
| 2010/0287764 | A1* | 11/2010 | McGregor et al. | 29/623.5 |
| 2010/0289609 | A1 | 11/2010 | Liao et al. | |
| 2011/0024670 | A1 | 2/2011 | Otsuki et al. | |
| 2011/0024671 | A1 | 2/2011 | Otsuki et al. | |
| 2011/0133881 | A1 | 6/2011 | Nakajima et al. | |
| 2011/0181384 | A1 | 7/2011 | Inuduka et al. | |
| 2011/0227690 | A1 | 9/2011 | Watanabe et al. | |
| 2011/0267167 | A1 | 11/2011 | Ogawa et al. | |
| 2012/0038449 | A1 | 2/2012 | Ogawa et al. | |
| 2012/0070567 | A1 | 3/2012 | Watanabe et al. | |
| 2013/0154786 | A1 | 6/2013 | Nakajima et al. | |

FOREIGN PATENT DOCUMENTS

| | | | |
|---|---|---|---|
| CN | 102007549 | A | 4/2011 |
| JP | H04-346204 | A | 12/1992 |
| JP | 07-201570 | A | 8/1995 |
| JP | H09-074011 | A | 3/1997 |
| JP | 2000-030925 | A | 1/2000 |
| JP | 2001-011563 | A | 1/2001 |
| JP | 2001-118725 | A | 4/2001 |
| JP | 2002-305108 | A | 10/2002 |
| JP | 2002-313620 | A | 10/2002 |
| JP | 2002-343618 | A | 11/2002 |
| JP | 2005286145 | A | 10/2005 |
| JP | 2007-019134 | A | 1/2007 |
| JP | 2007-027354 | A | 2/2007 |
| JP | 2007-027354 | A1 | 2/2007 |
| JP | 2007-123703 | A | 5/2007 |
| JP | 2007-258427 | A | 10/2007 |
| JP | 2007-299871 | A | 11/2007 |
| JP | 2008-028162 | A | 2/2008 |
| JP | 2008-041961 | A | 2/2008 |
| JP | 2008-195986 | A | 8/2008 |
| JP | 2009-088496 | A | 4/2009 |
| JP | 2009-088502 | A | 4/2009 |
| TW | 200845057 | A | 11/2008 |
| TW | M388724 | U1 | 9/2010 |
| WO | 2009/128425 | A1 | 10/2009 |
| WO | WO 2010013843 | A1 * | 2/2010 |

OTHER PUBLICATIONS

A Notification of Examination Opinions with Search Report issued by Taiwan Intellectual Property Office, mailed Dec. 19, 2013, for Taiwan counterpart application No. 100140964.

* cited by examiner

COIL COMPONENT

BACKGROUND

1. Field of the Invention

The present invention relates to a coil component structured in such a way that a helical coil is covered with a magnetic body.

2. Description of the Related Art

Coil components (so-called "inductance components"), representative examples of which are inductors, choke coils and transformers, are structured in such a way that a helical coil is covered with a magnetic body. For the magnetic body covering the coil, Ni—Cu—Zn ferrite and other ferrites (=ceramics whose main constituent is iron oxide) are generally used.

In recent years, there has been a demand for coil components of this type offering electrical current amplification (=higher rated current) and, to meet this need, switching the material for the magnetic body from conventional ferrites to Fe—Cr—Si alloy is being examined (refer to patent Literature 1).

This Fe—Cr—Si alloy has a higher saturated magnetic flux density than conventional ferrites, but its volume resistivity is much lower than conventional ferrites. In other words, to switch the material for magnetic body from conventional ferrites to Fe—Cr—Si alloy for a coil component of the type where the helical coil is directly contacting the magnetic body, such as a coil component of the laminated type or the powder-compacted type, an ingenious idea is needed to bring the volume resistivity of the magnetic body itself, which is constituted by Fe—Cr—Si alloy grains, closer to the volume resistivity of the magnetic body constituted by ferrite grains, or preferably increase the volume resistivity of the former beyond that of the latter.

In essence, without ensuring a high volume resistivity of the magnetic body itself which is constituted by Fe—Cr—Si alloy grains, the saturated magnetic flux density of the material cannot be utilized to increase the saturated magnetic flux density of the component and, due to the phenomenon of current leaking from the coil to the magnetic body and disturbing the magnetic field, the inductance of the component itself will drop.

Note that Patent Literature 1 mentioned above discloses a method for manufacturing a magnetic body for coil component of the laminated type, which comprises laminating a magnetic body layer formed by a magnetic paste containing Fe—Cr—Si alloy grains as well as a glass component, with a conductor pattern, baking the laminate in a nitrogen ambience (=reducing ambience), and then impregnating the baked laminate with a thermo-setting resin.

However, this manufacturing method allows the glass component in the magnetic paste to remain in the magnetic body, and this glass component in the magnetic body reduces the volume ratio of Fe—Cr—Si alloy grains, which in turn lowers the saturated magnetic flux density of the component itself.

Any discussion of problems and solutions involved in the related art has been included in this disclosure solely for the purposes of providing a context for the present invention, and should not be taken as an admission that any or all of the discussion were known at the time the invention was made.

PATENT LITERATURES

[Patent Literature 1] Japanese Patent Laid-open No. 2007-027354

SUMMARY

An object of the present invention is to provide a coil component of the type where a helical coil is directly contacting a magnetic body, where such coil component still meets the demand for electrical current amplification.

To achieve the aforementioned object, the present invention provides a coil component of the type where a helical coil covered with a magnetic body is directly contacting the magnetic body, wherein the aforementioned magnetic body is mainly constituted by magnetic alloy grains and substantially free of a glass component, and the aforementioned magnetic alloy grains have an oxide film of magnetic alloy grains on their surface.

In some embodiments, the term "oxide film" refers to a film formed by oxidization of magnetic alloy grains after being shaped into the magnetic body or the coil component, said film being substantially the sole film formed on the magnetic alloy grains in the magnetic body. In some embodiments, the term "directly contacting" refers to physically contacting without any additional intervening layers therebetween. In some embodiments, the term "mainly constituted by" refers to being materially constituted by, being characterized by, or being constituted by, as the main component. In some embodiments, the term "substantially free" refers to being free to a degree equivalent to zero, being materially free, containing less than 5% or less than 1%, or containing less than a detectable degree. In some embodiments, the magnetic alloy grains are bonded to each other mostly via the oxide film and partially directly without the oxide film. In some embodiments, the magnetic alloy grains adjacent to the coil are bonded to the coil via the oxide film without any additional intervening layers therebetween. In this disclosure, any defined meanings do not necessarily exclude ordinary and customary meanings in some embodiments. Also, in this disclosure, "the invention" or "the present invention" refers to at least one of the embodiments or aspects explicitly, necessarily, or inherently disclosed herein. Further, in this disclosure, "a" may refer to a species or a genus including multiple species. The term "magnetic alloy grains" refers to magnetic alloy grains including an oxide film formed thereon, but also refers to magnetic alloy grains without an oxide film, depending on the context.

According to the present invention, magnetic alloy grains constituting the magnetic body have an oxide film (=insulation film) of magnetic alloy grains on their surface, and magnetic alloy grains in the magnetic body directly bind with one another via the oxide film that serves as an insulation film, and also magnetic alloy grains near the coil adhere to the coil via the oxide film that serves as an insulation film, and for these reasons a high volume resistivity of the magnetic body mainly constituted by magnetic alloy grains can be ensured. In addition, since the magnetic body does not contain a glass component, the volume ratio of magnetic alloy grains does not drop unlike when there is a glass component in the magnetic body, which prevents the saturated magnetic flux density of the component itself from dropping due to a lower volume ratio.

In other words, although the coil component is of the type where the coil is directly contacting the magnetic body, the saturated magnetic flux density of the component itself can be increased by effectively utilizing the saturated magnetic flux density of the magnetic alloy material, which helps meet the demand for electrical current amplification and also prevents the phenomenon of current leaking from the coil to the magnetic body and disturbing the magnetic field, which in turn prevents the inductance of the component itself from dropping.

The aforementioned object and other objects, constitution/characteristics and operation/effects of the present invention are made clear by the following explanations and attached drawings.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

Figure 1:
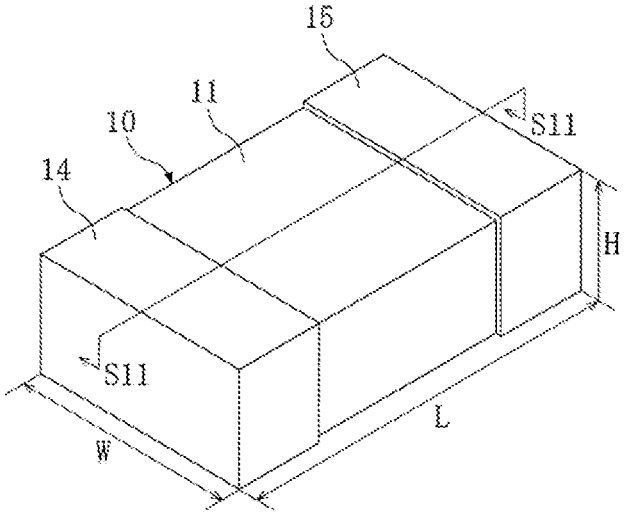
FIG. 1 is an external perspective view of a coil component of the laminated type.

1 - - - Magnetic alloy grain
2 - - - Oxide film
3 - - - Pore
4 - - - Mixture of solvent and binder
10 - - - Coil component
11 - - - Main component body
12 - - - Magnetic body
13 - - - Coil
14, 15 - - - External terminal

DETAILED DESCRIPTION

[Example of Specific Structure of Coil Component]

First, an example of specific structure where the present invention is applied to a coil component of the laminated type is explained by referring to FIGS. 1 to 5.

Figure 2:
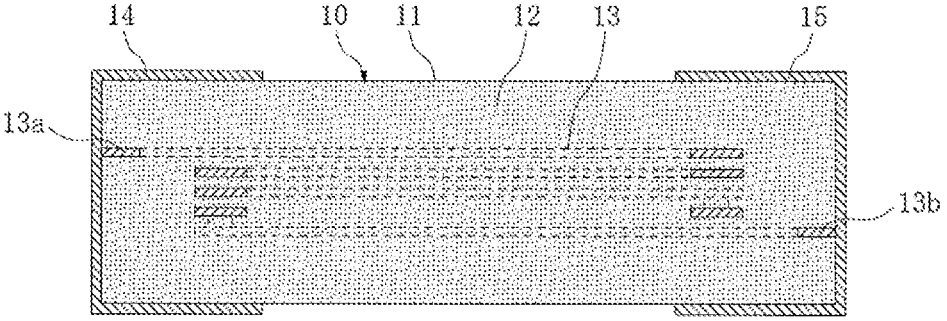
FIG. 2 is an enlarged sectional view taken along line S11-S11 in FIG. 1.

A coil component 10 shown in FIG. 1 has a rectangular solid shape of approx. 3.2 mm in length L, approx. 1.6 mm in width W, and approx. 0.8 mm in height H. This coil component 10 has a main component body 11 of rectangular solid shape and a pair of external terminals 14, 15 provided at both ends in the length direction of the main component body 11. As shown in FIG. 2, the main component body 11 has a magnetic body 12 of rectangular solid shape and a helical coil 13 covered with the magnetic body 12, where one end of the coil 13 is connected to the external terminal 14, while the other end is connected to the external terminal 15.

Figure 3:
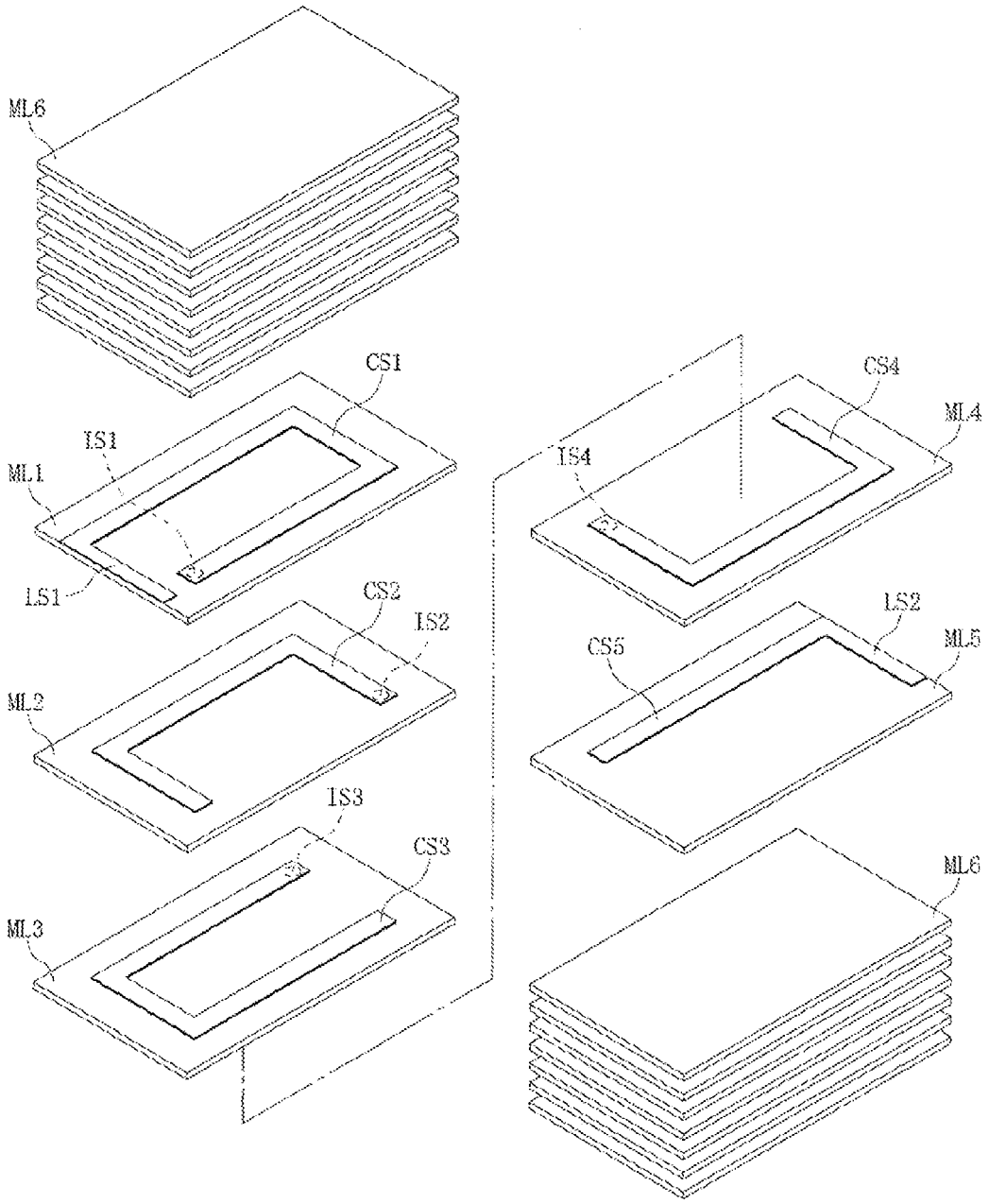
FIG. 3 is an exploded view of the component shown in FIG. 1.

As shown in FIG. 3, the magnetic body 12 is structured in such a way that a total of 20 layers of magnetic layers ML1 to ML6 are put together and it has a length of approx. 3.2 mm, width of approx. 1.6 mm, and thickness (height) of approx. 0.8 mm. The length, width and thickness of each of the magnetic layers ML1 to ML6 are approx. 3.2 mm, approx. 1.6 mm and approx. 40 μm, respectively. This magnetic body 12 is mainly constituted by Fe—Cr—Si alloy grains and does not contain a glass component. The composition of the Fe—Cr—Si alloy grains is 88 to 96.5 percent by weight of Fe, 2 to 8 percent by weight of Cr, and 1.5 to 7 percent by weight of Si.

Figure 4:
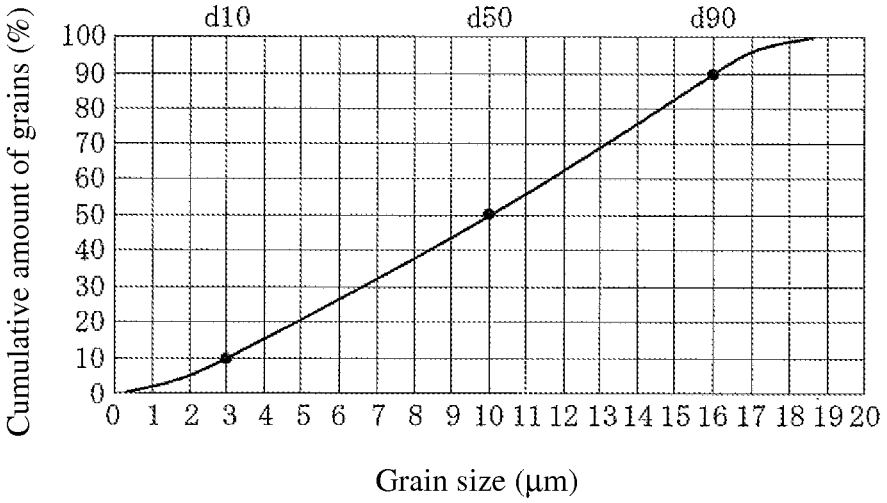
FIG. 4 is a graph showing the granularity distribution of grains constituting the magnetic body shown in FIG. 2.
Figure 5:
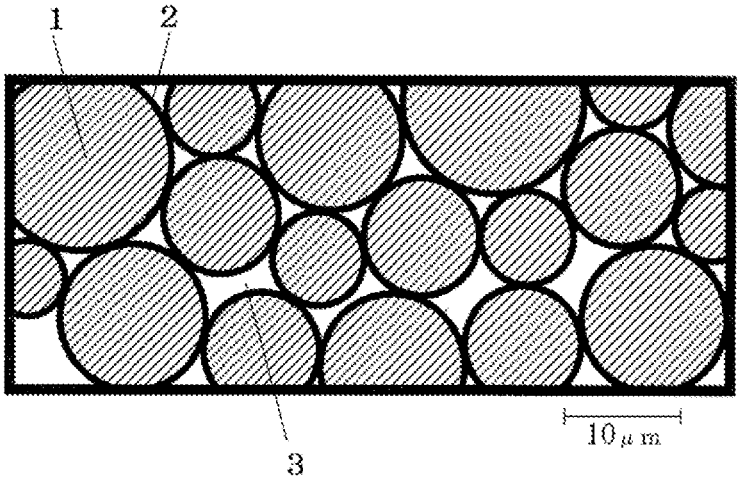
FIG. 5 is a schematic view showing the condition of grains according to an image obtained by observing the magnetic body in FIG. 2 with a transmission electron microscope.

As shown in FIG. 4, Fe—Cr—Si alloy grains constituting the magnetic body 12 have a d50 (median diameter) of 10 μm, d10 of 3 μm and d90 of 16 μm when their grain size is considered based on volume, where d10/d50 is 0.3 and d90/d50 is 1.6. Also as shown in FIG. 5, an oxide film (=insulation film) 2 of Fe—Cr—Si alloy grains is present on the surface of each Fe—Cr—Si alloy grain 1, and Fe—Cr—Si alloy grains 1 in the magnetic body 12 bind with one another via the oxide film 2 that serves as an insulation film, while Fe—Cr—Si alloy grains 1 near the coil 13 adhere to the coil 13 via the oxide film 2 that serves as an insulation film. This oxide film 2 has been confirmed to contain at least the magnetic substance $Fe_3O_4$ and non-magnetic substances $Fe_2O_3$ and $Cr_2O_3$.

It should be noted that FIG. 4 shows a granularity distribution measured with a grain-size/granularity-distribution measuring apparatus utilizing the laser diffraction scattering method (Microtrack manufactured by Nikkiso Co., Ltd.). FIG. 5 shows a schematic view of the condition of grains according to an image obtained by observing the magnetic body 12 with a transmission electron microscope. Fe—Cr—Si alloy grains 1 constituting the magnetic body 12 are not actually perfect spheres, but all grains here are depicted as spheres in order to illustrate that their grain sizes have a distribution. Also, while the thickness of the oxide film 2 present on the surface of each grain actually varies over a range of 0.05 to 0.2 μm, the oxide film 2 here is depicted as having a uniform thickness throughout in order to illustrate that the oxide film 2 is present on the grain surface.

As shown in FIG. 3, the coil 13 is structured in such a way that a total of five coil segments CS1 to CS5, and a total of four relay segments IS1 to IS4 connecting the coil segments CS1 to CS5, are put together in a helical pattern and the number of windings is approx. 3.5. This coil 13 is mainly constituted by Ag grains. When their grain size is considered based on volume, Ag grains have a d50 (median diameter) of 5 μm.

The four coil segments CS1 to CS4 have a C shape, while one coil segment CS5 has a thin strip shape. Each of the coil segments CS1 to 5 has a thickness of approx. 20 μm and width of approx. 0.2 mm. The top coil segment CS1 has an L-shaped leader part LS1 which is continuously formed with the coil segment and utilized to connect to external terminal 14, while the bottom coil segment CS5 also has an L-shaped leader part LS2 which is continuously formed with the coil segment and utilized to connect to external terminal 15. Each of the relay segments IS1 to IS4 has a column shape that passes through the corresponding magnetic layer ML1, ML2, ML3 or ML4, where each segment has a bore of approx. 15 μm.

As shown in FIGS. 1 and 2, the external terminals 14, 15 cover each end face, in the length direction, of the main component body 11 as well as four side faces near the end face, and have a thickness of approx. 20 μm. The one external terminal 14 connects to the edge of the leader part LS1 of the top coil segment CS1, while the other external terminal 15 connects to the edge of the leader part LS2 of the bottom coil segment CS5. These external terminals 14, 15 are mainly constituted by Ag grains. When their grain size is considered based on volume, Ag grains have a d50 (median diameter) of 5 μm.

[Example of Specific Method for Manufacturing Coil Component]

Next, an example of a specific method for manufacturing the aforementioned coil component 10 is explained by referring to FIGS. 3, 5, 6 and 7.

When manufacturing the aforementioned coil component 10, a doctor blade, die coater, or other coating machine (not illustrated) is used to coat a prepared magnetic paste onto the surface of a plastic base film (not illustrated), after which the coated base film is dried at approx. 80° C. for approx. 5 minutes using a hot-air dryer or other dryer (not illustrated), to create first to sixth sheets that correspond to the magnetic layers ML1 to ML6 (refer to FIG. 3), respectively, and have a size appropriate for multiple-part processing.

The composition of the magnetic paste used here is 85 percent by weight of Fe—Cr—Si alloy grains, 13 percent by weight of butyl carbitol (solvent) and 2 percent by weight of polyvinyl butyral (binder), where Fe—Cr—Si alloy grains have the d50 (median diameter), d10 and d90 as mentioned earlier.

Next, a stamping machine, laser processing machine, or other piercing machine (not illustrated) is used to pierce the first sheet corresponding to the magnetic layer ML1 (refer to FIG. 3), to form through holes corresponding to the relay segment IS1 (refer to FIG. 3) in a specified layout. Similarly, the second to fourth sheets corresponding to the magnetic layers ML2 to ML4 (refer to FIG. 3) are pierced to form through holes corresponding to the relay segments IS2 to IS4 (refer to FIG. 3) in specified layouts.

Next, a screen printer, gravure printer or other printer (not illustrated) is used to print a prepared conductive paste onto the surface of the first sheet corresponding to the magnetic layer ML1 (refer to FIG. 3), after which the printed sheet is dried at approx. 80° C. for approx. 5 minutes using a hot-air dryer or other dryer (not illustrated), to create a first printed layer corresponding to the coil segment CS1 (refer to FIG. 3) in a specified layout. Similarly, second to fifth printed layers corresponding to the coil segments CS2 to CS5 (refer to FIG. 3) are created in specified layouts on the surfaces of the second to fifth sheets corresponding to the magnetic layers ML2 to ML5 (refer to FIG. 3).

The composition of the conductive paste used here is 85 percent by weight of Ag grains, 13 percent by weight of butyl carbitol (solvent) and 2 percent by weight of polyvinyl butyral (binder), where Ag grains have the d50 (median diameter) as mentioned earlier.

The through holes formed in specified layouts in the first to fourth sheets corresponding to the magnetic layers ML1 to ML4 (refer to FIG. 3) are positioned in a manner overlapping with the edges of the first to fourth printed layers in specified layouts, respectively, so that part of the conductive paste is filled in each through hole when the first to fourth printed layers are created, to form first to fourth filled parts corresponding to the relay segments IS1 to IS4 (refer to FIG. 3).

Next, a suction transfer machine and press machine (both not illustrated) are used to stack in the order shown in FIG. 3 and thermally compress the first to fourth sheets (corresponding to the magnetic layers ML1 to ML4) each having a printed layer and filled part, the fifth sheet (corresponding to the magnetic layer ML5) having only a printed layer, and the sixth sheet (corresponding to the magnetic layer ML6) having neither a printed layer nor filled part, to create a laminate.

Next, a dicing machine, laser processing machine, or other cutting machine (not illustrated) is used to cut the laminate to the size of the main component body to create a chip before heat treatment (including a magnetic body and coil before heat treatment).

Next, a baking furnace or other heat treatment machine (not illustrated) is used to heat-treat multiple chips before heat treatment in batch in an atmosphere or other oxidizing ambience. This heat treatment includes a binder removal process and an oxide film forming process, where the binder removal process is implemented under conditions of approx. 300° C. for approx. 1 hour, while the oxide film forming process is implemented under conditions of approx. 750° C. and approx. 2 hours.

Figure 6:
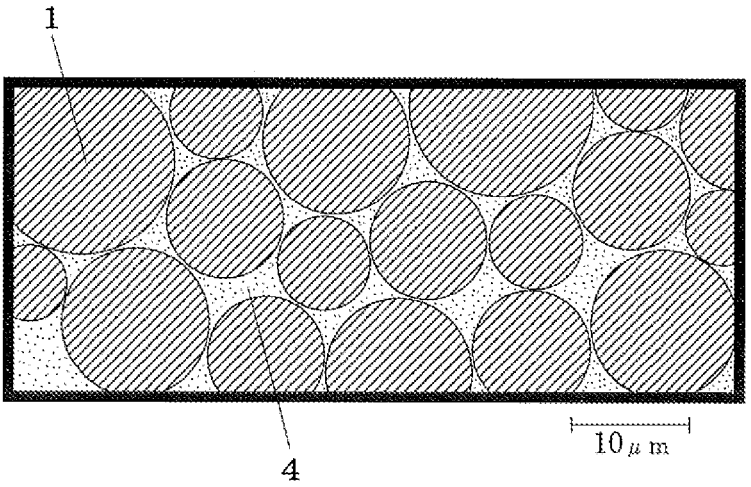
FIG. 6 is a schematic view showing the condition of grains according to an image obtained by observing the magnetic body before the binder removal process with a transmission electron microscope.
Figure 7:
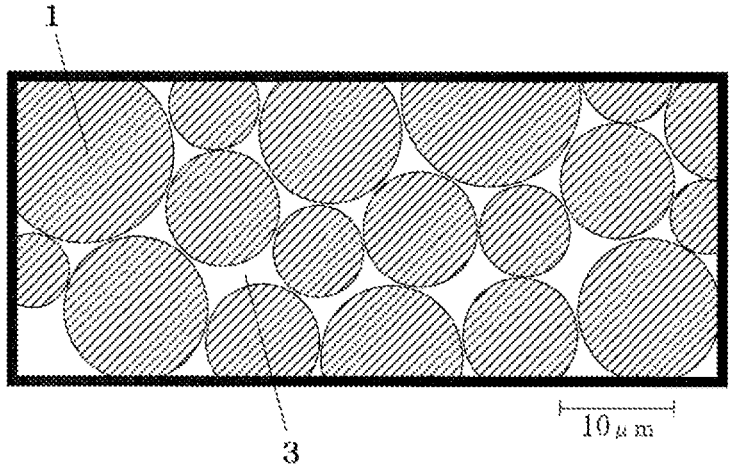
FIG. 7 is a schematic view showing the condition of grains according to an image obtained by observing the magnetic body after the binder removal process with a transmission electron microscope.

As shown in FIG. 6, before the binder removal process, the chip before heat treatment has many fine voids between Fe—Cr—Si alloy grains 1 in the magnetic body before heat treatment and, while these fine voids are filled with a mixture 4 of solvent and binder, this mixture is lost in the binder removal process and therefore by the time the binder removal process is completed, these fine voids have changed to pores 3, as shown in FIG. 7. Also, while many fine voids are present between Ag grains in the coil before heat treatment and these fine voids are filled with a mixture of solvent and binder, this mixture is lost in the binder removal process.

In the oxide film forming process after the binder removal process, Fe—Cr—Si alloy grains 1 in the magnetic body before heat treatment gather closely to create the magnetic body 12 (refer to FIGS. 1 and 2), as shown in FIG. 5, while at the same time the oxide film 2 of Fe—Cr—Si alloy grains 1 is formed on the surface of each grain 1. Also, Ag grains in the coil before heat treatment are sintered to create the coil 13 (refer to FIGS. 1 and 2), thereby creating the main component body 11 (refer to FIGS. 1 and 2).

FIGS. 6 and 7 provide schematic views of the condition of grains according to images obtained by observing the magnetic bodies before and after the binder removal process with a transmission electron microscope. Fe—Cr—Si alloy grains 1 constituting the magnetic body before heat treatment are actually not perfect spheres, but all grains here are depicted as spheres to maintain consistency with FIG. 5.

Next, a dip coater, roller coater, or other coater (not illustrated) is used to coat a prepared conductive paste onto both ends in the length direction of the main component body 11, and then the coated main component body is baked in a baking furnace or other heat treatment machine (not illustrated) under conditions of approx. 600° C. for approx. 1 hour to remove the solvent and binder in the baking process, while also sintering the Ag grains, to create the external terminals 14, 15 (refer to FIGS. 1 and 2).

The composition of the conductive paste used here is 85 percent by weight of Ag grains, 13 percent by weight of butyl carbitol (solvent) and 2 percent by weight of polyvinyl butyral (binder), where Ag grains have the d50 (median diameter) as mentioned earlier.

[Effects]

Next, the effects of the aforementioned coil component 10 are explained by referring to Sample No. 4 in Table 1.

TABLE 1

| Sample | d50 (μm) | d10 (μm) | d90 (μm) | d10/d50 | d90/d50 | Volume resistivity (Ω · cm) | | L × Idc1 (μH · A) | |
|---|---|---|---|---|---|---|---|---|---|
| No. 1 | 10 | 0.5 | 16 | 0.05 | 1.6 | $1.1 \times 10^9$ | ○ | 4.7 | X |
| No. 2 | 10 | 1 | 16 | 0.1 | 1.6 | $9.5 \times 10^8$ | ○ | 6.5 | ○ |
| No. 3 | 10 | 2 | 16 | 0.2 | 1.6 | $6.0 \times 10^8$ | ○ | 7.2 | ○ |
| No. 4 | 10 | 3 | 16 | 0.3 | 1.6 | $5.2 \times 10^8$ | ○ | 8.3 | ○ |
| No. 5 | 10 | 4 | 16 | 0.4 | 1.6 | $4.1 \times 10^8$ | ○ | 8.3 | ○ |
| No. 6 | 10 | 5 | 16 | 0.5 | 1.6 | $9.0 \times 10^7$ | ○ | 8.4 | ○ |
| No. 7 | 10 | 6 | 16 | 0.6 | 1.6 | $5.6 \times 10^7$ | ○ | 8.4 | ○ |
| No. 8 | 10 | 7 | 16 | 0.7 | 1.6 | $2.1 \times 10^7$ | ○ | 8.4 | ○ |

TABLE 1-continued

| Sample | d50 (μm) | d10 (μm) | d90 (μm) | d10/d50 | d90/d50 | Volume resistivity (Ω · cm) | | L × Idc1 (μH · A) | |
|---|---|---|---|---|---|---|---|---|---|
| No. 9 | 10 | 8 | 16 | 0.8 | 1.6 | $8.5 \times 10^6$ | X | 8.5 | ○ |
| No. 10 | 10 | 9 | 16 | 0.9 | 1.6 | $3.1 \times 10^6$ | X | 8.5 | ○ |
| No. 11 | 10 | 3 | 13 | 0.3 | 1.3 | $1.0 \times 10^9$ | ○ | 5.0 | X |
| No. 12 | 10 | 3 | 14 | 0.3 | 1.4 | $9.5 \times 10^8$ | ○ | 5.8 | ○ |
| No. 13 | 10 | 3 | 15 | 0.3 | 1.5 | $7.3 \times 10^8$ | ○ | 7.2 | ○ |
| No. 4 | 10 | 3 | 16 | 0.3 | 1.6 | $5.2 \times 10^8$ | ○ | 8.3 | ○ |
| No. 14 | 10 | 3 | 17 | 0.3 | 1.7 | $3.7 \times 10^8$ | ○ | 8.3 | ○ |
| No. 15 | 10 | 3 | 18 | 0.3 | 1.8 | $2.0 \times 10^8$ | ○ | 8.3 | ○ |
| No. 16 | 10 | 3 | 19 | 0.3 | 1.9 | $1.0 \times 10^8$ | ○ | 8.3 | ○ |
| No. 17 | 10 | 3 | 20 | 0.3 | 2.0 | $8.7 \times 10^7$ | ○ | 8.3 | ○ |
| No. 18 | 10 | 3 | 30 | 0.3 | 3.0 | $4.6 \times 10^7$ | ○ | 8.4 | ○ |
| No. 19 | 10 | 3 | 40 | 0.3 | 4.0 | $2.6 \times 10^7$ | ○ | 8.4 | ○ |
| No. 20 | 10 | 3 | 50 | 0.3 | 5.0 | $1.1 \times 10^7$ | ○ | 8.5 | ○ |
| No. 21 | 10 | 3 | 55 | 0.3 | 5.5 | $7.0 \times 10^6$ | X | 8.5 | ○ |
| No. 22 | 10 | 3 | 60 | 0.3 | 6.0 | $4.2 \times 10^6$ | X | 8.6 | ○ |

With the aforementioned coil component 10, Fe—Cr—Si alloy grains constituting the magnetic body 12 each have an oxide film (=insulation film) of Fe—Cr—Si alloy grains on the surface, and Fe—Cr—Si alloy grains in the magnetic body 12 bind with one another via the oxide film that serves as an insulation film, while Fe—Cr—Si alloy grains near the coil 13 adhere to the coil 13 via the oxide film that serves as an insulation film, and therefore a high volume resistivity can be ensured for the magnetic body itself which is mainly constituted by Fe—Cr—Si alloy grains. Also, the magnetic body 12 does not contain a glass component, so the volume ratio of Fe—Cr—Si alloy grains does not drop, unlike when there is a glass component in the magnetic body 12, which prevents the saturated magnetic flux density of the component itself from dropping due to a lower volume ratio.

In other words, although the coil component is of the type where the coil 13 is directly contacting the magnetic body 12, the saturated magnetic flux density of the component itself can be increased by effectively utilizing the saturated magnetic flux density of the Fe—Cr—Si alloy material, which helps meet the demand for electrical current amplification and also prevents the phenomenon of current leaking from the coil 13 to the magnetic body 12 and disturbing the magnetic field, which in turn prevents the inductance of the component itself from dropping.

This effect can also be demonstrated by the volume resistivity and L×Idc1 of Sample No. 4 in Table 1 that corresponds to the aforementioned coil component 10. Each volume resistivity (Ω·cm) shown in Table 1 indicates the volume resistivity of the magnetic body 12 itself, measured with a commercial LCR meter. On the other hand, each L×Idc1 (μH·A) shown in Table 1 indicates the product of the initial inductance (L) and the direct-current bias current (Idc1) when the initial inductance (L) has dropped by 20%, measured at a measurement frequency of 100 kHz using a commercial LCR meter.

Now, the acceptance judgment criteria for volume resistivity and L×Idc1 are explained. Given the fact that conventional coil components generally use Ni—Cu—Zn ferrite, among other ferrites, for their magnetic body, a coil component was created based on the same structure and using the same manufacturing method as those used by the aforementioned coil component 10, except that "Ni—Cu—Zn ferrite grains with a d50 (median diameter) of 10 μm, when their grain size is considered based on volume, were used instead of Fe—Cr—Si alloy grains" and that "a baking process was adopted under conditions of approx. 900° C. for approx. 2 hours, instead of the oxide film forming process" (the obtained coil component is hereinafter referred to as the "comparative coil component").

When the volume resistivity and L×Idc1 of the magnetic body of this comparative coil component were measured in the same manners as mentioned above, the volume resistivity was $5.0 \times 10^6$ Ω·cm, while L×Idc1 was 5.2 μH·A. With conventional coil components using Ni—Cu—Zn ferrite grains, however, the volume resistivity of the magnetic body is increased to $1.0 \times 10^7$ Ω·cm or higher by manipulating the grain composition, impregnating it with resin, or using other methods, and accordingly the acceptance judgment criterion for volume resistivity was set to "$1.0 \times 10^7$ Ω·cm"; i.e., values equal to or higher than this criterion value were judged "acceptable (○)," while those lower than the criterion value were judged "unacceptable (X)." Meanwhile, the acceptance judgment criterion for L×Idc1 was set to the measured value of L×Idc1 of the comparative coil component, or specifically "5.2 μH·A"; i.e., values higher than this criterion value were judged "acceptable (○)," while those equal to or lower than the criterion value were judged "unacceptable."

As evident from the volume resistivity and L×Idc1 of Sample No. 4, the volume resistivity of Sample No. 4 corresponding to the aforementioned coil component 10 is $5.2 \times 10^8$ Ω·cm, which is higher than the aforementioned acceptance judgment criterion for volume resistivity ($1.0 \times 10^7$ Ω·cm), while L×Idc1 of Sample No. 4 corresponding to the aforementioned coil component 10 is 8.3 which is higher than the aforementioned acceptance judgment criterion for L×Idc1 (5.2 μH·A), and therefore these values demonstrate the aforementioned effects.

[Verification of Optimal Granularity Distribution]

Next, the result of verification of an optimal granularity distribution (d10/d50 and d90/d50) of Fe—Cr—Si alloy grains constituting the magnetic body 12 of the aforementioned coil component 10 (Sample No. 4) is explained by referring to Table 1.

With the aforementioned coil component 10 (Sample No. 4), the Fe—Cr—Si alloy grains used to constitute the magnetic body 12 had a d50 (median diameter) of 10 μm, d10 of 3 μm and d90 of 16 μm when their grain size was considered based on volume. Whether or not effects similar to those explained above could be obtained using grains of a different granularity distribution (d10/d50 and d90/d50) was evaluated.

Sample Nos. 1 to 3 and 5 to 10 shown in Table 1 are coil components having the same structure and made by the same manufacturing method as those used by the aforementioned coil component 10, except that "Fe—Cr—Si alloy grains having a different d10 value from that of the aforementioned coil component 10 (Sample No. 4) were used." Also, Sample Nos. 11 to 22 shown in Table 1 are coil components having the same structure and made by the same manufacturing method as those used by the aforementioned coil component 10 (Sample No. 4), except that "Fe—Cr—Si alloy grains having a different d90 value from that of the aforementioned coil component 10 (Sample No. 4) were used."

As evident from the volume resistivity and L×Idc1 values of Sample Nos. 1 to 10, a volume resistivity higher than the aforementioned acceptance judgment criterion for volume resistivity ($1.0 \times 10^7$ Ω·cm) can be obtained as long as d10 is 7 μm or less, while a L×Idc1 higher than the aforementioned acceptance judgment criterion for L×Idc1 (5.2 μH·A) can be obtained as long as d10 is 1 μm or more. In other words, excellent volume resistivity and L×Idc1 can be obtained as long as d10 is in a range of 1 to 7.0 μm (d10/d50 is in a range of 0.1 to 0.7).

Also, as is evident from the volume resistivity and L×Idc1 values of Sample Nos. 11 to 22, a volume resistivity higher than the aforementioned acceptance judgment criterion for volume resistivity ($1.0\times10^7$ Ω·cm) can be obtained as long as d90 is 50 μm or less, while a L×Idc1 higher than the aforementioned acceptance judgment criterion for L×Idc1 (5.2 μH·A) can be obtained as long as d90 is 14 μm or more. In other words, excellent volume resistivity and L×Idc1 can be obtained as long as d90 is in a range of 14 to 50 μm (d90/d50 is in a range of 1.4 to 5.0).

In essence, the above confirms that, as long as d10/d50, when the grain size is considered based on volume, is in a range of 0.1 to 0.7 and d90/d50 is in a range of 1.4 to 5.0, Fe—Cr—Si alloy grains whose granularity distribution (d10/d50 and d90/d50) is different can be used to achieve the same effects as mentioned above.

[Verification of Optimal Median Diameter]

Next, the result of verification of optimal median diameter (d50) of Fe—Cr—Si alloy grains constituting the magnetic body 12 of the aforementioned coil component 10 (Sample No. 4) is explained by referring to Table 2.

TABLE 2

| Sample | d50 (μm) | d10 (μm) | d90 (μm) | d10/d50 | d90/d50 | Volume resistivity (Ω · cm) | | L × Idc1 (μH · A) | |
|---|---|---|---|---|---|---|---|---|---|
| No. 23 | 1 | 0.3 | 1.6 | 0.3 | 1.6 | $4.1\times10^{10}$ | ○ | 3.4 | X |
| No. 24 | 2 | 0.6 | 3.2 | 0.3 | 1.6 | $9.3\times10^{9}$ | ○ | 5.0 | X |
| No. 25 | 3 | 0.9 | 4.8 | 0.3 | 1.6 | $5.1\times10^{9}$ | ○ | 7.2 | ○ |
| No. 26 | 4 | 1.2 | 6.4 | 0.3 | 1.6 | $2.2\times10^{9}$ | ○ | 7.5 | ○ |
| No. 27 | 5 | 1.5 | 8 | 0.3 | 1.6 | $9.2\times10^{8}$ | ○ | 7.7 | ○ |
| No. 4 | 10 | 3 | 16 | 0.3 | 1.6 | $5.2\times10^{8}$ | ○ | 8.3 | ○ |
| No. 28 | 15 | 4.5 | 24 | 0.3 | 1.6 | $9.6\times10^{7}$ | ○ | 8.4 | ○ |
| No. 29 | 20 | 6 | 32 | 0.3 | 1.6 | $1.1\times10^{7}$ | ○ | 8.6 | ○ |
| No. 30 | 21 | 6.3 | 33.6 | 0.3 | 1.6 | $9.5\times10^{6}$ | X | 8.7 | ○ |
| No. 31 | 22 | 6.6 | 35.2 | 0.3 | 1.6 | $8.7\times10^{6}$ | X | 8.7 | ○ |

With the aforementioned coil component 10 (Sample No. 4), the Fe—Cr—Si alloy grains used to constitute the magnetic body 12 had a d50 (median diameter) of 10 d10 of 3 μm and d90 of 16 μm when their grain size was considered based on volume. Whether or not effects similar to those explained above could be obtained using grains of a different d50 (median diameter) was checked.

Sample Nos. 23 to 31 shown in Table 2 are coil components having the same structure and made by the same manufacturing method as those used by the aforementioned coil component 10 (Sample No. 4), except that "Fe—Cr—Si alloy grains having a different d50 (median diameter) value from that of the aforementioned coil component 10 (Sample No. 4) were used."

As is evident from the volume resistivity and L×Idc1 values of Sample Nos. 23 to 31, a volume resistivity higher than the aforementioned acceptance judgment criterion for volume resistivity ($1.0\times10^7$ Ω·cm) can be obtained as long as d50 is 20 μm or less, while a L×Idc1 higher than the aforementioned acceptance judgment criterion for L×Idc1 (5.2 μH·A) can be obtained as long as d50 is 3 μm or more. In other words, excellent volume resistivity and L×Idc1 can be obtained as long as d50 (median diameter) is in a range of 3 to 20 μm.

In essence, the above confirms that, as long as d50 (median diameter) when the grain size is considered based on volume is in a range of 3.0 to 20.0 μm Fe—Cr—Si alloy grains whose d50 (median diameter) is different can be used to achieve the same effects as mentioned above.

[Application to Other Coil Component]

Next, whether or not the ranges of values mentioned in the section "Verification of Optimal Granularity Distribution" and the section "Verification of Optimal Median Diameter" above can be applied (1) when the specific manufacturing method is different from the aforementioned coil component 10 (Sample No. 4), (2) when the type of coil component is the same but the specific structure is different from the aforementioned coil component 10 (Sample No. 4), (3) when grains different from the aforementioned coil component 10 (Sample No. 4) are used for the magnetic body 12, and (4) when the type of coil component is different from the aforementioned coil component 10 (Sample No. 4), is explained.

(1) In the sction "Example of Specific Method for Manufacturing Coil Component" above, the composition of magnetic paste was set to 85 percent by weight of Fe—Cr—Si alloy grains, 13 percent by weight of butyl carbitol (solvent) and 2 percent by weight of polyvinyl butyral (binder). However, the weights by percent of solvent and binder can be changed without presenting problems as long as the solvent and binder are removed in the binder removal process, to manufacture the same coil component as the aforementioned coil component 10 (Sample No. 4). The same applies to the composition of conductive paste.

Also, while butyl carbitol was used as the solvent for each paste, any other ether or even alcohol, ketone, ester, etc., can be used without presenting problems, instead of butyl carbitol, as long as it does not chemically react with Fe—Cr—Si alloy grains or Ag grains, and the same coil component as the aforementioned coil component 10 (Sample No. 4) can be manufactured using Pt grains or Pd grains instead of Ag grains.

In addition, while polyvinyl butyral was used as the binder for each paste, any other cellulose resin or even polyvinyl acetal resin, acrylic resin, etc., can be used without presenting problems, instead of polyvinyl butyral, as long as it does not chemically react with Fe—Cr—Si alloy grains or Ag grains, to manufacture the same coil component as the aforementioned coil component 10 (Sample No. 4).

Furthermore, the same coil component as the aforementioned coil component 10 (Sample No. 4) can be manufactured without presenting problems in particular, even when an appropriate amount of any dispersant, such as nonionic surface active agent or anionic surface active agent, is added to each paste.

Moreover, while the conditions of approx. 300° C. for approx. 1 hour were used for the binder removal process, other conditions can be set to manufacture the same coil component as the aforementioned coil component 10 (Sample No. 4), as long as the solvent and binder can be removed.

Also, while the conditions of approx. 750° C. for approx. 2 hours were used for the oxide film forming process, other conditions can be set to manufacture the same coil component as the aforementioned coil component 10 (Sample No. 4), as long as an oxide film of Fe—Cr—Si alloy grain can be formed on the surface of each grain and the properties of Fe—Cr—Si alloy grains do not change.

Furthermore, while the conditions of approx. 600° C. for approx. 1 hour were used for the baking process, other conditions can be set to manufacture the same coil component as the aforementioned coil component 10 (Sample No. 4), as long as the conductive paste can be baked without problems.

In essence, the ranges of values mentioned in the section "Verification of Optimal Granularity Distribution" and the section "Verification of Optimal Median Diameter" above can be applied even when the specific manufacturing method is different from the aforementioned coil component 10 (Sample No. 4).

(2) In the section "Example of Specific Structure of Coil Component" above, the magnetic body 12 had a length of approx. 3.2 mm, width of approx. 1.6 mm and thickness (height) of approx. 0.8 mm. However, the size of the magnetic body 12 has bearing only on the reference value of saturated magnetic flux density of the component itself, so effects equivalent to those mentioned in the section "Effects" above can be achieved even when the size of the magnetic body 12 is changed.

Also, while the coil 13 had approx. 3.5 windings, the number of windings of the coil 13 has bearing only on the reference value of inductance of the component itself, so effects equivalent to those mentioned in the section "Effects" above can be achieved even when the number of windings of the coil 13 is changed, and effects equivalent to those mentioned in the section "Effects" above can be achieved even when the dimensions or shapes of the segments CS1 to CS5 and IS1 to IS4 constituting the coil 13 are changed.

In essence, the ranges of values mentioned in the section "Verification of Optimal Granularity Distribution" and the section "Verification of Optimal Median Diameter" above can be applied even when the type of coil component is the same but the specific structure is different from the aforementioned coil component 10 (Sample No. 4).

(3) In the section "Example of Specific Structure of Coil Component" above, Fe—Cr—Si alloy grains were used to constitute the magnetic body 12, but effects equivalent to those mentioned in the section "Effects" above can be achieved by using, for example, Fe—Si—Al alloy grains or Fe—Ni—Cr alloy grains instead, as long as the saturated magnetic flux density of the magnetic alloy grain material itself is higher than that of the conventional ferrite and an oxide film (=insulation film) is formed on the surface through heat treatment in an oxidizing ambience.

In essence, the ranges of values mentioned in the section "Verification of Optimal Granularity Distribution" and the section "Verification of Optimal Median Diameter" above can be applied even when magnetic alloy grains different from the aforementioned coil component 10 (Sample No. 4) are used for the magnetic body 12.

(4) In the section "Example of Specific Structure of Coil Component" above, the coil component 10 was of the laminated type, but effects equivalent to those mentioned in the section "Effects" above can be achieved by adopting the present invention to a coil component of the powder-compacted type, for example, as long as the type of coil component is such that a helical coil is directly contacting a magnetic body. Here, a "coil component of the powder-compacted type" refers to a coil component structured in such a way that a prepared helical coil wire is buried in a magnetic body made of magnetic powder using a press machine and, as long as Fe—Cr—Si alloy grains are used as the magnetic powder to constitute the magnetic body and the magnetic body is pressed and then heat-treated under the same conditions as those used in the aforementioned oxide film forming process, effects equivalent to those mentioned in the section "Effects" above can be achieved.

In essence, the ranges of values mentioned in the section "Verification of Optimal Granularity Distribution" and the section "Verification of Optimal Median Diameter" above can be applied even when the type of coil component is different from the aforementioned coil component 10 (Sample No. 4).

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments.

The present application claims priority to Japanese Patent Application No. 2011-009886, filed Jan 20, 2011 and Japanese Patent Application No. 2011-232371, filed Oct 24, 2011, each disclosure of which is incorporated herein by reference in its entirety. In some embodiments, as the magnetic body, those disclosed in co-assigned U.S. Patent Application No. 13/092,381 (now U.S. Patent No. 8,813,346 ) and No. 13/277,018 (now U.S. Patent No. 8,723,634 ) can be used, each disclosure of which is incorporated herein by reference in its entirety. Above U.S. Patent No. 8,723,634 expressly states: "In some embodiments, by the oxidizing treatment, an oxide layer is formed on surfaces of the material grains by oxidizing Cr, Al, or the like ("another element") which is an element constituting the material grains other than iron and which oxidizes more easily than iron, so that the oxide layer contains the other element in a quantity larger (e.g., 3 to 100 times higher, 5 to 10 times higher) than that in the material grains as shown in FIG. 5, for example. In some embodiments, the material grains contain about 2% to about 8% by weight of Cr or Al (e.g., more than 3%). In some embodiments, the duration and the temperature of the oxidizing treatment are controlled so that the unprocessed grains aggregated via a binder can form an oxide layer thereon while partially sintering, i.e., performing partial grain growth, and also, the composition of the oxide layer can be controlled. As a result, in some embodiments, the grains are bonded with each other via the oxide layer and also via partial grain growth (some grains are partially fused (metal to metal bonding) with each other where the oxide layer is not formed while maintaining general shapes of the grains). The above can be observed by a SEM wherein some grains have cross-section outlines which can be fully observed as individual grains (each grain is fully covered with an oxide layer), and some grains have cross-section outlines which are connected to each other (grains are partially fused to each other, e.g., at least about ⅔of the outline of individual grains are maintained), as illustrated in FIG. 1 of Japanese patent application No. 2011-222093, filed Oct 6, 2011 (which claims priority to Japanese patent application No. 2011-100095, filed Apr 27, 2011 ), the disclosure of which is herein incorporated by reference in its entirety. In some embodiments, the partially fused grains are connected, where no oxide layer or no other layer is formed, by, for example, metallic bonding where metal atoms of the grains are bonded together, by metal-to-metal connection where metal portions of the grains are contacted with each other without metallic bonding, and/or by bonding/connection partially using metallic bonding. In some embodiments, more non-fused grains than partially-fused grains may be observed, and in other embodiments, more partially-fused grains than non-fused grains may be observed, adjusting magnetic characteristics and volume resistance, for example, when a coil-type electronic component is constituted by the grains. The ratio of the number of fused grains to the total number of grains may be about 5% to about 80% (including 10%, 20%, 30%, 40%, 50%, 60%, 70%, and values between any the foregoing). Alternatively, substantially all grains are non-fused and have individual cross-section outlines." U.S. Patent No. 8,723,634 at column 16, line 48 to column 17, line 27.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A coil component of the type where a helical coil covered with a magnetic body is directly contacting the magnetic body, said coil component characterized in that the magnetic body is mainly constituted by magnetic alloy grains, other than ferrite grains, and does not contain a glass component, wherein the magnetic alloy grains consist of grains made of a magnetic alloy and an oxide of the magnetic alloy, said oxide being film covering the surface of the grains, said magnetic alloy grains being bonded together by the oxide film without any other binder and by metal-to-metal bonding of the grains made of the magnetic alloy where no oxide film is formed.

2. The coil component according to claim 1, characterized in that the oxide film of the magnetic alloy grains is formed on their surface through heat treatment in an oxidizing ambience.

3. The coil component according to claim 2, characterized in that the magnetic alloy grains are Fe-Cr-Si alloy grains.

4. The coil component according to claim 1, characterized in that, when their grain size is considered based on volume, the magnetic alloy grains have their d10/d50 in a range of 0.1 to 0.7 and d90/d50 in a range of 1.4 to 5.0.

5. The coil component according to claim 2, characterized in that, when their grain size is considered based on volume, the magnetic alloy grains have their d10/d50 in a range of 0.1 to 0.7 and d90/d50 in a range of 1.4 to 5.0.

6. The coil component according to claim 3, characterized in that, when their grain size is considered based on volume, the magnetic alloy grains have their d10/d50 in a range of 0.1 to 0.7 and d90/d50 in a range of 1.4 to 5.0.

7. The coil component according to claim 1, characterized in that, when their grain size is considered based on volume, the magnetic alloy grains have their d50 in a range of 3.0 to 20.0 μm.

8. The coil component according to claim 2, characterized in that, when their grain size is considered based on volume, the magnetic alloy grains have their d50 in a range of 3.0 to 20.0 μm.

9. The coil component according to claim 3, characterized in that, when their grain size is considered based on volume, the magnetic alloy grains have their d50 in a range of 3.0 to 20.0 μm.

10. The coil component according to claim 4, characterized in that, when their grain size is considered based on volume, the magnetic alloy grains have their d50 in a range of 3.0 to 20.0 μm.

11. The coil component according to claim 5, characterized in that, when their grain size is considered based on volume, the magnetic alloy grains have their d50 in a range of 3.0 to 20.0 μm.

12. The coil component according to claim 6, characterized in that, when their grain size is considered based on volume, the magnetic alloy grains have their d50 in a range of 3.0 to 20.0 μm.

13. A coil component comprising:

a magnetic body having a main structure constituted by magnetic alloy grains, other than ferrite grains, and being free of a glass component, wherein the magnetic alloy grains consist of grains made of a magnetic alloy and an oxide of the magnetic alloy, said oxide being film covering the surface of the grains, said magnetic alloy grains being bonded together by the oxide film without any other binder and by metal-to-metal bonding of the grains made of the magnetic alloy where no oxide film is formed; and a helical coil being in contact with and covered with the magnetic body, wherein a portion between the helical coil and magnetic alloy grains of the magnetic body adjacent to the helical coil is constituted by an oxide film formed between the helical coil and the adjacent magnetic alloy grains by oxidization of the adjacent magnetic alloy grains, and the adjacent magnetic alloy grains are bonded to the helical coil via the oxide film.

14. The coil component according to claim 13, wherein the helical coil is made of a sintered material of a conductive paste, said sintered material being formed when the oxide film is formed between the adjacent magnetic alloy grains and between the helical coil and the adjacent magnetic alloy grains.

15. The coil component according to claim 13, wherein the magnetic alloy grains are Fe-Cr-Si alloy grains.

16. The coil component according to claim 13, wherein the magnetic alloy grains have a size distribution such that d10 /d50 is in a range of 0.1 to 0.7 and d90/d50 is in a range of 1.4 to 5.0, wherein d10, d50, and d90 represent the $10^{th}$ percentile size, $50^{th}$ percentile size, and $90^{th}$ percentile size based on volume, respectively.

17. The coil component according to claim 13, wherein the magnetic alloy grains have their d50 in a range of 3.0 to 20.0 μm, wherein d50 represents the $50^{th}$ percentile size based on volume.

18. The coil component according to claim 1, wherein the magnetic alloy grains are also bonded by direct bonding of grains without the oxide film.

19. The coil component according to claim 1, magnetic alloy grains in the magnetic body near the helical coil are bonded to the helical coil by the oxide film without any other binder.

20. The coil component according to claim 13, wherein the adjacent magnetic alloy grains are bonded to the helical coil by the oxide film without any other binder.

* * * * *